US007322949B2

(12) United States Patent
Shimizu

(10) Patent No.: US 7,322,949 B2
(45) Date of Patent: Jan. 29, 2008

(54) MASSAGE DEVICE FOR LOWER-LIMBS ON A STAND

(75) Inventor: Nobuzo Shimizu, Osaka (JP)

(73) Assignee: Daito Electric Machine Industry Company Limited, Osaka (JP)

( * ) Notice: Subject to any disclaimer, the term of this patent is extended or adjusted under 35 U.S.C. 154(b) by 635 days.

(21) Appl. No.: 10/492,089

(22) PCT Filed: Dec. 19, 2002

(86) PCT No.: PCT/JP02/13349

§ 371 (c)(1),
(2), (4) Date: Apr. 9, 2004

(87) PCT Pub. No.: WO03/065966

PCT Pub. Date: Aug. 14, 2003

(65) Prior Publication Data

US 2004/0243029 A1 Dec. 2, 2004

(30) Foreign Application Priority Data

Feb. 6, 2002 (JP) ..... 2002-029848

(51) Int. Cl.
*A61H 7/00* (2006.01)

(52) U.S. Cl. ..... 601/90; 601/95; 601/133

(58) Field of Classification Search ..... 601/34, 601/35, 49, 86, 90, 98, 95, 101, 103, 104, 601/27–32, 133; 297/423.41, 423.44, 423.45, 297/423.46; 482/115–119
See application file for complete search history.

(56) References Cited

U.S. PATENT DOCUMENTS 621,098 A * 3/1899 Kelly ..... 248/371
2,542,098 A * 2/1951 Walters ..... 601/27
4,873,966 A * 10/1989 Gitter ..... 601/63
6,113,182 A * 9/2000 Wise ..... 297/119
2001/0004679 A1 * 6/2001 Ichikawa ..... 601/98

FOREIGN PATENT DOCUMENTS

| | | |
|---|---|---|
| JP | 56-83348 A | 7/1981 |
| JP | 56-136554 | 10/1981 |
| JP | 56-136554 A | 10/1981 |
| JP | 56-136555 A | 10/1981 |
| JP | 1983-63131 | 4/1983 |
| JP | 11-299564 | 11/1999 |
| JP | 2000-217657 | 8/2000 |
| JP | 2001-112834 | 4/2001 |
| JP | 2001-112834 A | 4/2001 |

* cited by examiner

*Primary Examiner*—Danton DeMille
(74) *Attorney, Agent, or Firm*—Birch, Stewart, Kolasch & Birch, LLP

(57) ABSTRACT

A lower-limb massage machine is provided with a stand having an upper stand member disposed on an upper portion of a lower stand member to be placed on a floor surface, and a casing. The casing has a pair of right and left recess portions, on its face side, extending in a front-and-rear direction so that lower limbs are fitted in the recess portions, respectively. The casing is supported rotatably around an axis extending in a right-and-left direction with respect to the upper stand member, a massage mechanism incorporated in the casing for massaging the lower limbs. Also provided is an attitude holding mechanism for holding the casing at an attitude with respect to the upper stand member to which the casing is rotated. Accordingly, the attitude and height of the casing of the lower-limb massage machine can easily adjusted.

9 Claims, 7 Drawing Sheets

MASSAGE DEVICE FOR LOWER-LIMBS ON A STAND

TECHNICAL FIELD

The present invention relates to a massage machine for lower limbs which is suitable for massaging the lower legs of a human being.

BACKGROUND ART

A variety of lower-limb massage machines suitable for massaging lower limbs of a human being at the same time have been hitherto developed, and for example, Japanese Unexamined Patent Publication No. 2001-112834 discloses one of these massage machines.

The lower-limb massage machine disclosed in this publication is equipped with a casing having a pair of right and left recess portions extending in the front-and-rear direction on its face side, a massage mechanism which is incorporated in the casing for massaging both the lower limbs fitted in the respective recess portions at the same time, and elevating means equipped on a back side of the casing for adjustment of height.

The lower-limb massage machine described above, however, can be used under only a state that the recess portions are positioned upside because the machine is configured to be placed on a floor surface through the elevating means. Therefore, although the height of the casing can be adjusted by the elevating means, no function of varying the attitude (rotational angle) of the casing is provided. Furthermore, it cannot be designed to have versatility such as a use of the back side of the casing as a foot rest or the like.

Therefore, in view of the foregoing situation, the present invention has an object to provide a stationary-type lower-limb massage machine having a function of readily adjusting the attitude and height of a casing. In addition, the present invention has an object to enhance versatility of the machine by adding a function of a foot rest to the machine.

DISCLOSURE OF THE INVENTION

In order to attain the above objects, the present invention takes the following technical means.

That is, a lower-limb massage machine according to the present invention comprises: a stand having a lower stand member to be placed on a floor surface and an upper stand member mounted on the lower stand member; a casing which has, on a face side thereof, a pair of right and left recess portions extending in a front-and-rear direction for receiving lower limbs fitted in the recess portions, respectively, and is supported by the upper stand member through a pivot shaft so as to be rotatable around an axis in a right-and-left direction of the pivot shaft; a massage mechanism incorporated in the casing for massaging the lower limbs fitted in the recess portions; and an attitude holding mechanism for holding the attitude of the casing with respect to the upper stand member at a position to which the casing is rotated.

With this arrangement, the casing is allowed to rotate so that the attitude of the casing with respect to the upper stand can be varied. Furthermore, the attitude of the casing after the rotation can be held by the attitude holding mechanism. Therefore, a user can freely change the angle of his/her lower limbs to be massaged.

Furthermore, the lower-limb massage machine according to the present invention is characterized in that a foot rest for resting lower limbs is formed on a back side of the casing, and the casing is pivotally mounted on the upper stand member so as to be reversible.

With this arrangement, the casing can be held in an attitude with the back side thereof positioned upside, so that the back side of the casing can be used as a foot rest. Therefore, the lower-limb massage machine can be also used as a foot rest, and the versatility can be enhanced.

Furthermore, the lower-limb massage machine according to the present invention is characterized in that the upper stand member is secured to the lower stand member through an angle varying mechanism for varying a bending angle of the stand in the front-and-rear direction.

Preferably, the angle varying mechanism may comprise a ratchet mechanism for varying the bending angle stepwise.

Accordingly, the bending angle of the upper stand member with respect to the lower stand member is stepwisely varied by using the angle changing mechanism, so that the angle and height of the casing can be varied. Therefore, a user can massage his/her lower limbs at freely varied angle and height.

Furthermore, the lower-limb massage machine according to the present invention is characterized in that the attitude holding mechanism includes a pair of set members which are secured to the upper stand member and the pivot shaft of the casing, respectively, and brought into contact with each other in a face-to-face manner, and resistance applying means for applying rotational resistance force between the set members so as to restrict the rotation of the casing by pressing one of the pair of set members in a face-to-face direction against the other set member and applying a force larger than the rotational resistance force to allow the rotation of the casing.

Accordingly, the rotation of the casing is restricted, and the casing can be prevented from being freely moved. Furthermore, the rotation of the casing is allowed by the force against the rotational resistance force.

Furthermore, the lower-limb massage machine according to the present invention is characterized in that the upper stand member has a pair of right and left side arms, the casing is rotatably provided between the side arms through a pivot shaft extending in the right-and-left direction, and the resistance applying means elastically presses one set member against the other set member.

Accordingly, the one set member is pressed against the other set member by the elastic force of the side arms, so that the resistance applying means does not need any press member such as a spring or the like, and it can be formed with a simple construction.

Furthermore, the lower-limb massage machine according to the present invention is characterized in that the resistance applying means has an engagement recess and projection portion provided on each of the confronting faces of the pair of set members, the engagement recess and projection portions being engage able with each other by a pressing force and are disengage able from one another by the force against the pressing force.

Accordingly, the engagement between the engagement recess and projection portions applies rotational resistance force between the pair of set members to restrict the rotation of the casing. In addition, the engagement state between the engagement recess and projection portions is released by the force larger than the rotational resistance force, thereby allowing the rotation of the casing.

Furthermore, the lower-limb massage machine is characterized in that the attitude holding mechanism has lock means for increasing the pressing force of the one set member against the other set member to prevent the rotation of the casing.

Accordingly, by operating the lock means, the one set member is pressed by the other set member so as to prevent the rotation of the other set member. Therefore, the rotation of the casing is temporarily fixed, and thus the attitude thereof is held.

Still furthermore, the lower-limb massage machine is characterized in that the upper stand member is provided with rotation range restricting means for restricting the rotation of the casing around the axis of the pivot shaft to less than one turn.

Preferably, the rotation range restricting means has a rotary disc member fixed to the pivot shaft and having a radially outwardly projecting portion, and a stopper fixed to the upper stand member for restricting the rotation of the rotary disc member through an engagement with the projecting portion.

Accordingly, the casing is restricted from being rotated by one or more turn, and thus the casing can be easily reversed.

BEST MODE FOR CARRYING OUT THE INVENTION

A best mode of the present invention will be described hereunder with reference to the drawings.

Figure 1:
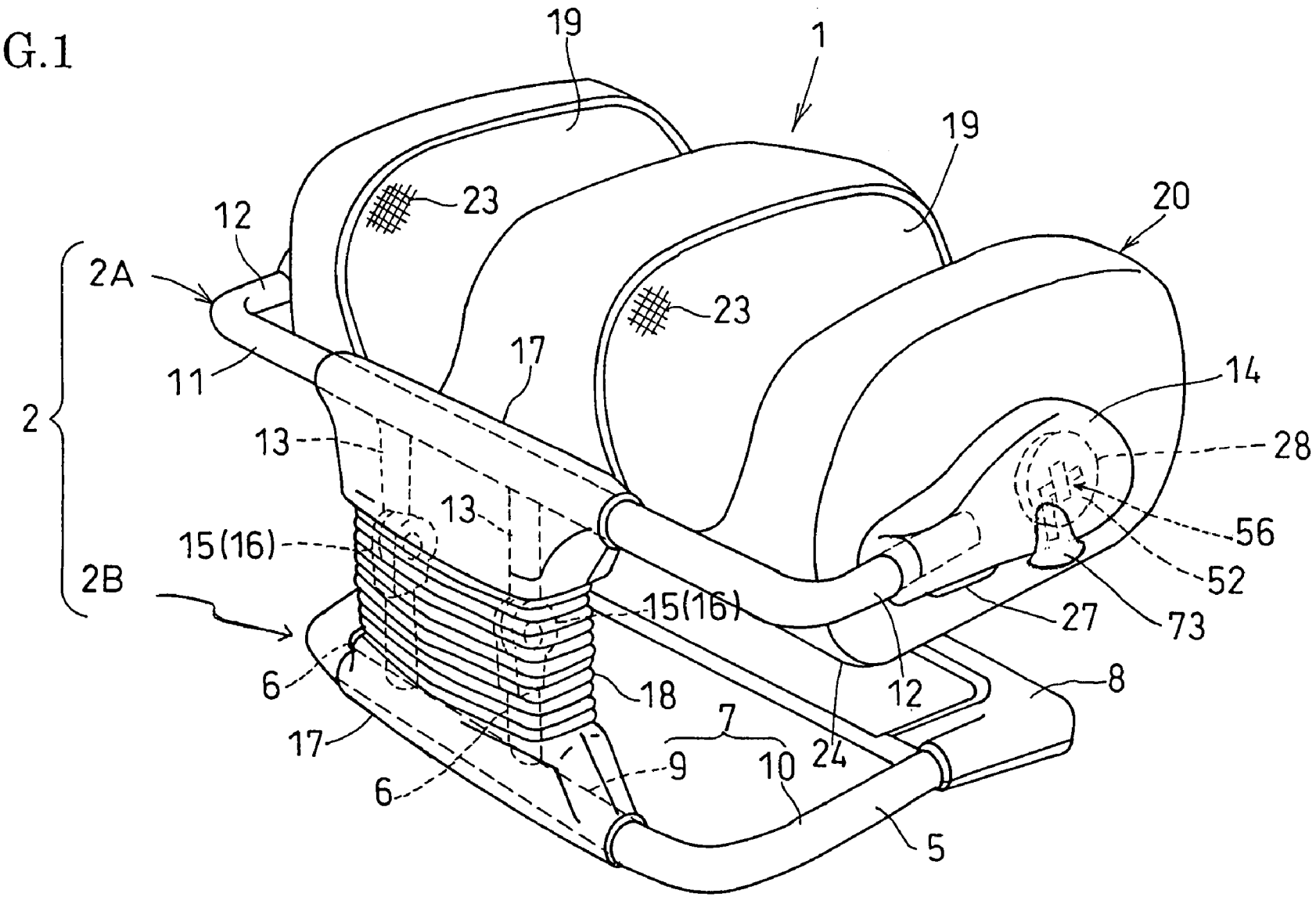
FIG. 1 is a perspective view showing a lower-limb massage machine according to the present invention.
Figure 2:
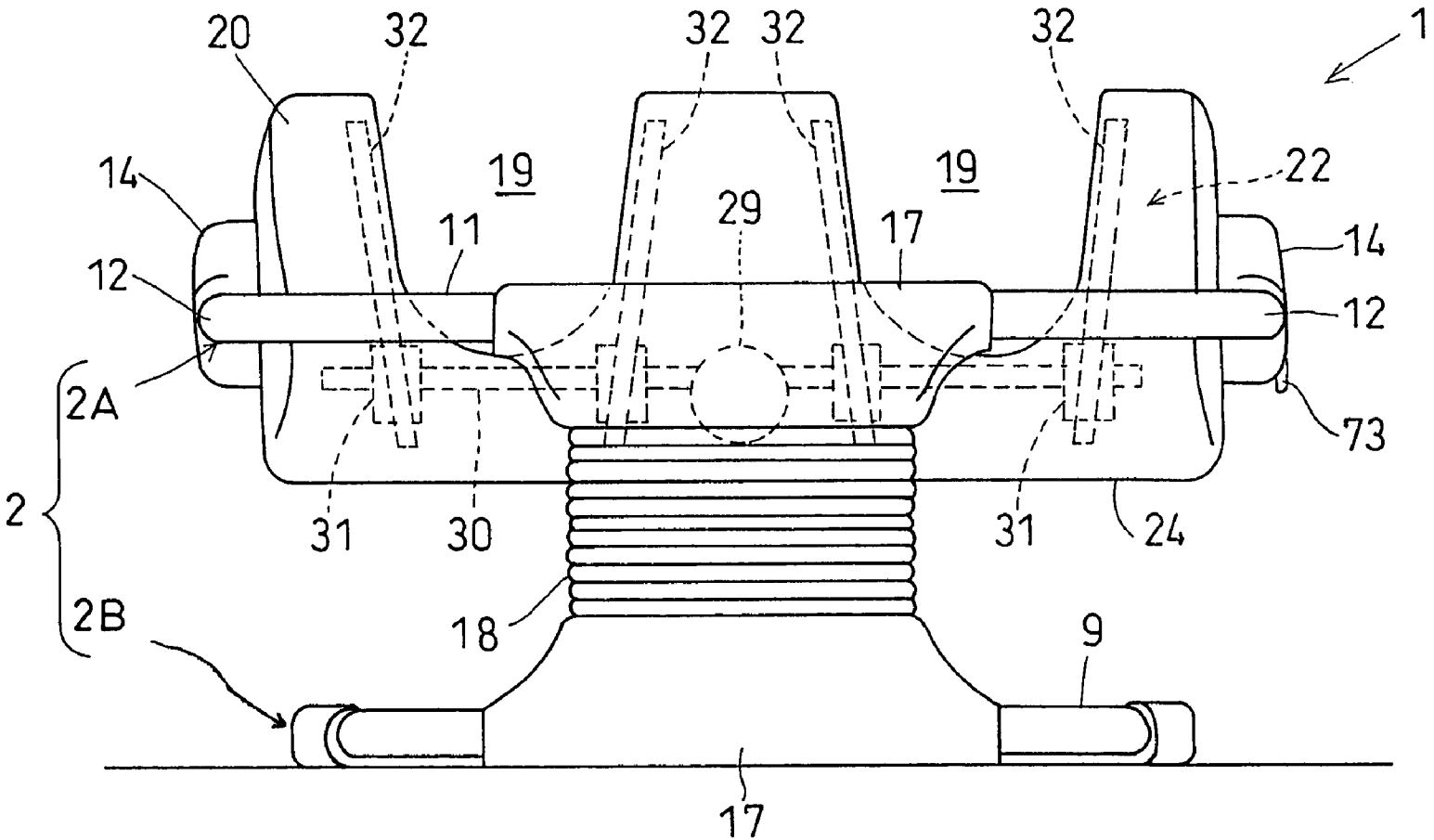
FIG. 2 is a front view of the massage machine.

As shown in FIGS. 1 and 2, a lower-limb massage machine 1 is used while placed on a floor surface such as a flooring or the like. An upper stand member 2A is fixed to an upper portion of a lower stand member 2B on the floor surface to constitute a stand 2, and a casing 20 is mounted on the upper stand member 2A so as to be rotatable around an axis extending in a right-and-left direction.

The lower stand member 2B comprises a base portion 5 designed in a substantially rectangular shape in plan view, and a pair of right and left lower support poles 6 uprightly extending from a front end portion of the base portion 5. The base portion 5 comprises a base frame 7 formed by bending a metal pipe, and a plastic base plate 8 through which free ends of the frame 7 are connected to each other.

The base frame 7 comprises a front bar 9 extending in the right-and-left direction, and a pair of right and left side bars 10 extending rearward from right and left ends of the front bar 9, respectively. The lower support poles 6 are fixed to a substantially center portion of the front bar 9 so as to be orthogonal to the front bar 9 while they are in parallel to each other.

The upper stand member 2A is formed of a metal pipe which is bent to have substantially the same size as the base frame 7 and a substantially U-shape in plan view including a front arm 11 extending in the right-and-left direction and a pair of right and left side arms 12 extending rearward from right and left ends of the front arm 11, respectively.

A pair of right and left upper support poles 13 are provided on a substantially center portion of the front arm 11 so as to extend downwardly. Lower end portions of the upper support poles 13 are joined to upper end portions of the lower support poles 6 of the lower stand member 2B, respectively, through angle varying mechanisms 16. Accordingly, the upper stand 2A and the lower stand 2B are unified into one body to form the stand 2 having a substantially U-shape in side view, wherein a bending angle of the upper stand member 2A with respect to the lower stand member 2B can be stepwisely varied.

A ratchet mechanism 15 is adopted as the angle varying mechanism 16. In the ratchet mechanism 15, engagement and disengagement of engagement pieces are stepwisely repeated by slightly upwardly rotating the side arm 12 of the upper stand member 2A and then downwardly returning the same, whereby the bending angle θ1 of the upper stand member 2A is increased every constant angle at plural steps (see FIGS. 3 to 5).

Furthermore, when the side arm 12 of the upper stand member 2A is rotated to an uppermost position, the engagement of the engagement pieces is released so that the side arm 12 is allowed to be rotated to a lowermost position so that change/adjustment of the bending angle of the upper stand member 2A can be restarted from an initial position.

The ratchet mechanism 15 is covered by a flexible cover 18 having a bellows-type hollow cylindrical body as shown in FIGS. 1 and 2, and the upper and lower ends thereof are connected to the substantial centers of the front bar 9 and the front arm 11 through center covers 17 formed of a plastic material or the like. Since the flexible cover 18 has a bellows-shape, it can be deformed following the bending state between the support poles 6 and 13 by the ratchet mechanisms 15.

Figure 6:
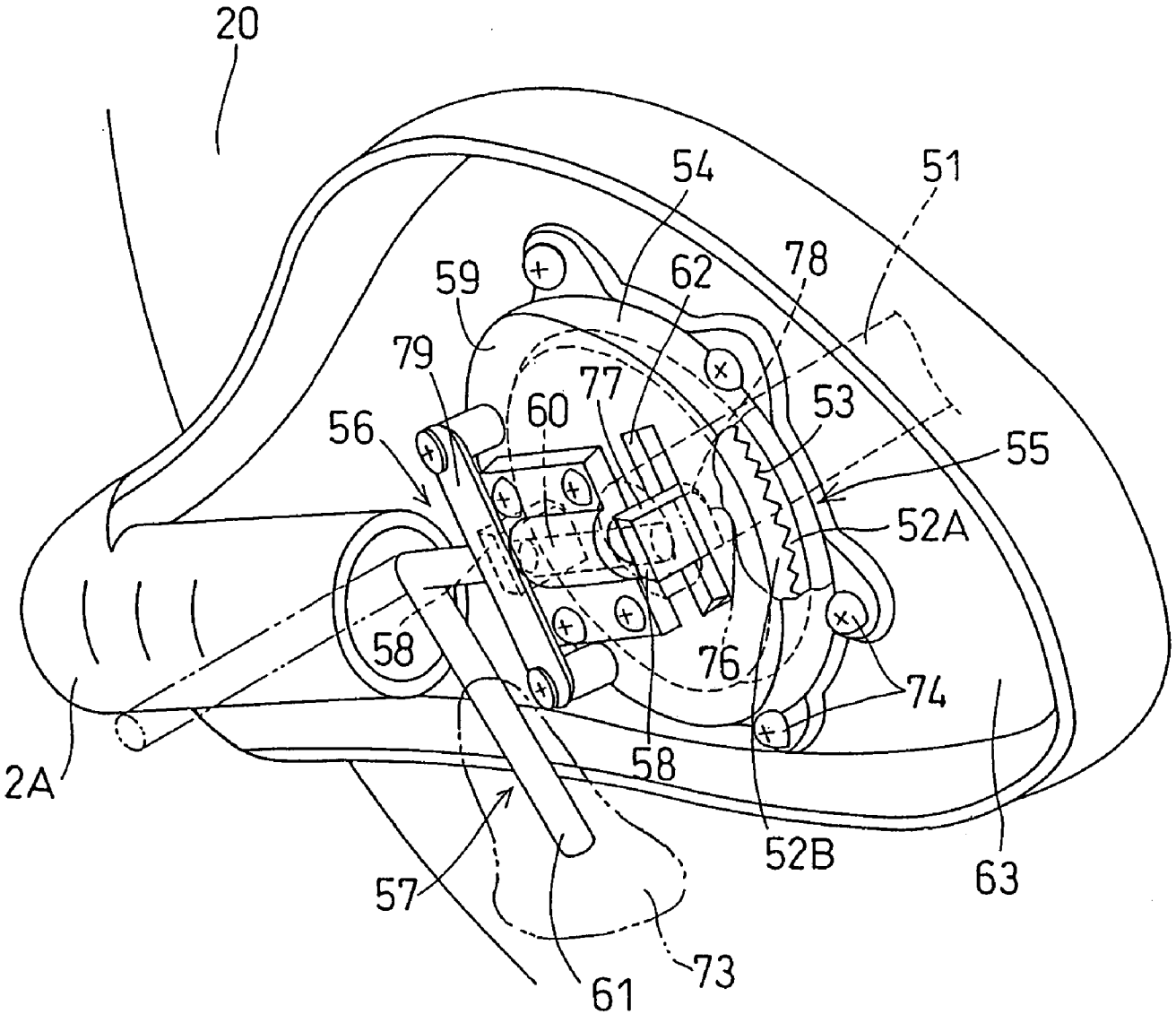
FIG. 6 is a perspective view showing an attitude holding mechanism.

Furthermore, a support side plate 63 is fixed to a tip end portion of each of the pair of right and left side arms 12 as shown in FIG. 6, and the support side plate 63 is covered by a plastic side cover 14. The support side plate 63 and the side cover 14 serve as a grip for upwardly and downwardly rotate the upper stand member 2A.

The casing 20 is rotatably supported between the side arms 12, that is, the support side plates 63 through pivot shafts 51 provided on opposite side surfaces of the casing in the right-and-left direction (the right-and-left direction of FIG. 2).

The casing 20 is formed of a plastic hollow box having a substantially rectangular shape in plan view, and a face side thereof is formed with a pair of right and left recess portions upwardly opening in the upper half portion of the casing 20 and extending in the front-and-rear direction. These openings are covered by an air-permeable and flexible cloth cover sheet 23. Each recess portion 19 has such a width and a depth that a calf portion of a lower limb 21 of a human being can be fitted therein.

Furthermore, a flat foot rest face 24 is formed on a back side of the casing 20 so that the right and left lower limbs 21 can be rested thereon. The foot rest face 24 is not necessarily flat insofar as the lower limbs can be rested. The foot rest face may be inclined in the front-and-rear direction or in the right-and-left direction, or may be formed with recessed and raised portions.

Furthermore, the casing 20 is provided with a massage mechanism 22 incorporated therein for massaging both the lower limbs 21 fitted in the respective recess portions 19 at the same time.

As shown in FIG. 2, the massage mechanism 22 includes a driving member 29 comprising a motor, a decelerating gear, and the like, a rotary shaft 30 which is rotated by the driving member 29 and bridged in the right-and-left direction, rotary cams 31 fixed to the rotary shaft 30, and totally four massage plates 32 each of which is swung along a slant cam face of each rotary cam 31, and the massage plates 32 are disposed so as to be proximate to inner right and left side surfaces of the respective recess portions 19.

Therefore, when the rotary shaft 30 is rotated by the driving member 29, both the massage plates 32 confronted to each other through each recess portion 19 make such a motion that they are repetitively approached to and separated from each other by the rotary cams 31, whereby the lower limbs 21 fitted in the recess portions 19 are pressed and kneaded from the right and left sides, thereby massaging the lower limbs.

Furthermore, one (on the right side) of the pair of right and left support side plates 63 fixed to the upper stand member 2A is provided with an attitude holding mechanism 28 for restricting the rotation of the casing 20 and holding the attitude thereof.

As shown in FIG. 6, the attitude holding mechanism 28 consists of a pivot shaft side set member 52B (other set member) of a substantially disc-shape fixed to the pivot shaft 51 for pivotally supporting the casing 20 so as to rotate in connection with the rotation of the pivot shaft 51, and a stand side set member 52A (one set member) having a size to be substantially overlapped with the pivot shaft side set member 52B and fixed to the support side plate 63 so as to confront the inside of the pivot shaft side set member 52B in the right-and-left direction.

Each of the confronting faces of the pivot shaft side set member 52B and the stand side set member 52A is formed with an engagement recess and projection portion 53 having a saw-tooth face so that the confronting faces are engage able with each other, and the stand side set member 52A is pressed in the face-to-face direction against the pivot support shaft side set member 52B by the pair of right and left side arms by means of an elastically deforming property of the upper stand member 2A having a U-shape in plan view, thereby constituting a resistance applying means 55.

The resistance applying means 55 enables the pair of engagement recess and projection portions 53 to be elastically restored, so that the projections are allowed to run on the projections and engage with the recesses on the confronting counterpart. Therefore, when the casing 20 is rotated around the pivot shaft 51, the pivot shaft side set member 52B is rotated while sliding on the stand side set member 52A under the state that the engagement recess and projection portion 53 of the pivot shaft side set member 52B is slid on the engagement recess and projection portion 53 of the stand side set member 52A while engaged with the engagement recess and projection portion 53 of the stand side set member 52A.

Accordingly, rotational resistance force is generated between the pair of set members 52A, 52B, and the casing 20 can be stopped at an interval corresponding to the pitch of the recesses and projections of the engagement recess and projection portion 53. Therefore, even if a user releases his/her hand, the casing 20 is not freely rotated and thus the attitude thereof is kept. The rotation of the casing is allowed by applying a force larger than the rotational resistance force to the casing 20.

The pivot shaft side set member 52B and the stand side set member 52A are covered by a case body 54 which is fixed to the support side plate 63 by a fixing piece 74 such as a screw or the like.

The case body 54 has an upper surface 59 on which lock means 56 is provided for bring the pivot shaft side set member 52B into close contact with the stand side set member 52A to restrict the rotation of the pivot shaft 51.

The lock means 56 comprises a substantially rectangularly bent rod-shaped lock member 57 having an end serving as a lock member base portion 61 and an opposite end serving as a lock member tip portion 60. An operating member 73 is fixed to the lock member base portion 61 for facilitating a grasping of this portion.

A pair of press pieces 58 for pressing the pivot shaft side set member 52B against the stand side set member 52A are secured to the lock member tip portion 60 to be arranged in pair in the longitudinal direction of the lock member tip portion 60. Each of the press pieces 58 is substantially rectangular and disposed so as to be eccentric from an axial center of the lock member tip portion 60, and an R portion 78 is formed between a projection edge 76 and a non-projection edge 77 of the press piece 58.

The lock member tip portion 60 is secured to the upper surface 59 of the case body 54 so as to be rotatable around the axial center thereof. In addition, a pair of openings 62 into which the pair of press pieces 58 are inserted to press the pivot shaft side set member 52B are formed in the upper surface 59.

Furthermore, a positioning member 79 for elastically positioning and holding the press piece 58 to a press state or a release state is disposed on the upper surface 59 of the case body 54 so as to stride over the lock member tip portion 60. The positioning member 79 is formed of an elastic material such as plastic material, and an edge of the press piece 58 abuts against the positioning member 79, whereby the press piece 58 is positioned.

When the lock member tip portion 60 is rotated so that the lock member base portion 61 is approached to the support side plate 63 while the operating member 73 is grasped as shown in FIG. 6, the press piece 58 is inserted in the opening 62, and the projection edge 76 presses the pivot shaft side set member 52B after the R portion 78 of the press piece 58 passes through the opening 62.

Then, the stand side set member 52A is attracted through the case body 54 to the pivot shaft side set member 52B while the side arm 12 is elastically deformed, so that the engagement recess and projection portion 53 of the stand side set member 52A is engaged with the engagement recess and projection portion 53 of the pivot shaft side set member 52B. Through the engagement between the engagement recess and projection portions 53, the sliding rotation of the pivot shaft side set member 52B is restricted, and thus the rotation of the casing pivot shaft 51 is prevented. Under this state, the casing 20 is temporarily kept under a fixed state with the attitude of the casing 20 kept unvaried even if the lower limbs are fitted into the casing 20.

Conversely, when the lock member base portion 61 is moved away from the support side plate 63, the press piece 58 is reversely rotated, and the projection edge 76 is separated from the pivot shaft side set member 52B. Accordingly, the pulled-state of the stand side set member 52A through the casing 54 is released, and the attitude of the casing 20 is allowed to be varied.

Furthermore, the support side plate 63 disposed on the other side (left side), that is, on the opposite side of the arrangement of the attitude holding mechanism 28 in the right-and-left direction, of the upper stand member 2A is provided with rotation range restricting means 65.

The rotation range restricting means 65 comprises a rotary disc member 66 having a radially outwardly projecting portion 67 and fixed to the other end of the pivot shaft 51, and a stopper 68 disposed outside of the peripheral edge of the rotary disc member 66 so as to engage with the projecting portion 67 to stop the rotation of the rotary disc member 66. The stopper 68 has a width in the peripheral direction of the rotary disc member 66 and is fixed to the support side plate 63 along the peripheral edge of the rotary disc member 66.

When the rotary disc member 66 is rotated in connection with the rotation of the casing 20 and the rotary disc member 66 abuts against each of both sides 69 in the width direction of the stopper 68, further rotation of the rotary disc member is restricted. Accordingly, the casing 20 is restrained from rotating one or more turn by the rotation range restricting means 65, and thus the casing 20 is allowed to be rotated only within a predetermined range.

Since the casing 20 having the recess portions 19 for massaging lower limbs on the face side thereof and the foot rest face 24 on the back side thereof, a 180 degree rotation is required for reversing the casing. However, if the casing 20 is allowed to rotate one or more turn, it is difficult to determine a stop position of the casing 20, resulting in a cumbersome handling of the casing.

Figure 7:
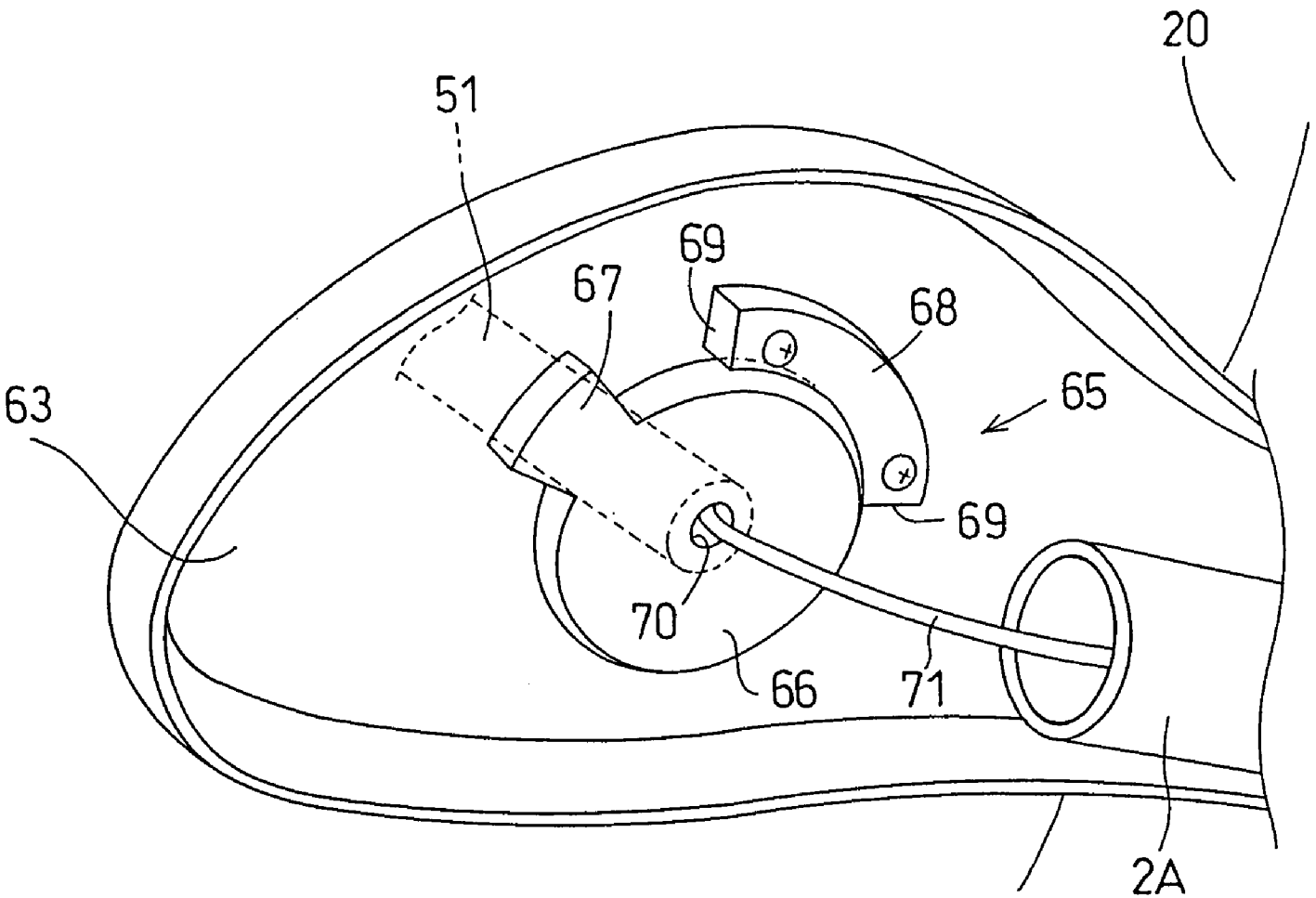
FIG. 7 is a perspective view showing rotation range restricting means.

Furthermore, an opening 70 is formed at a substantial center of the rotary disc member 66 as shown in FIG. 7, and a power supply cable 71 is drawn in the opening 70 to supply power to the massage mechanism 22 disposed in the casing 20.

As described above, since the casing 20 is prevented from being rotated in one direction many turns, the power cable 71 can be prevented from being twisted or cut out.

Next, mode of using thus constructed lower-limb massage machine 1 will be described with reference to FIGS. 3 to 5.

Figure 3:
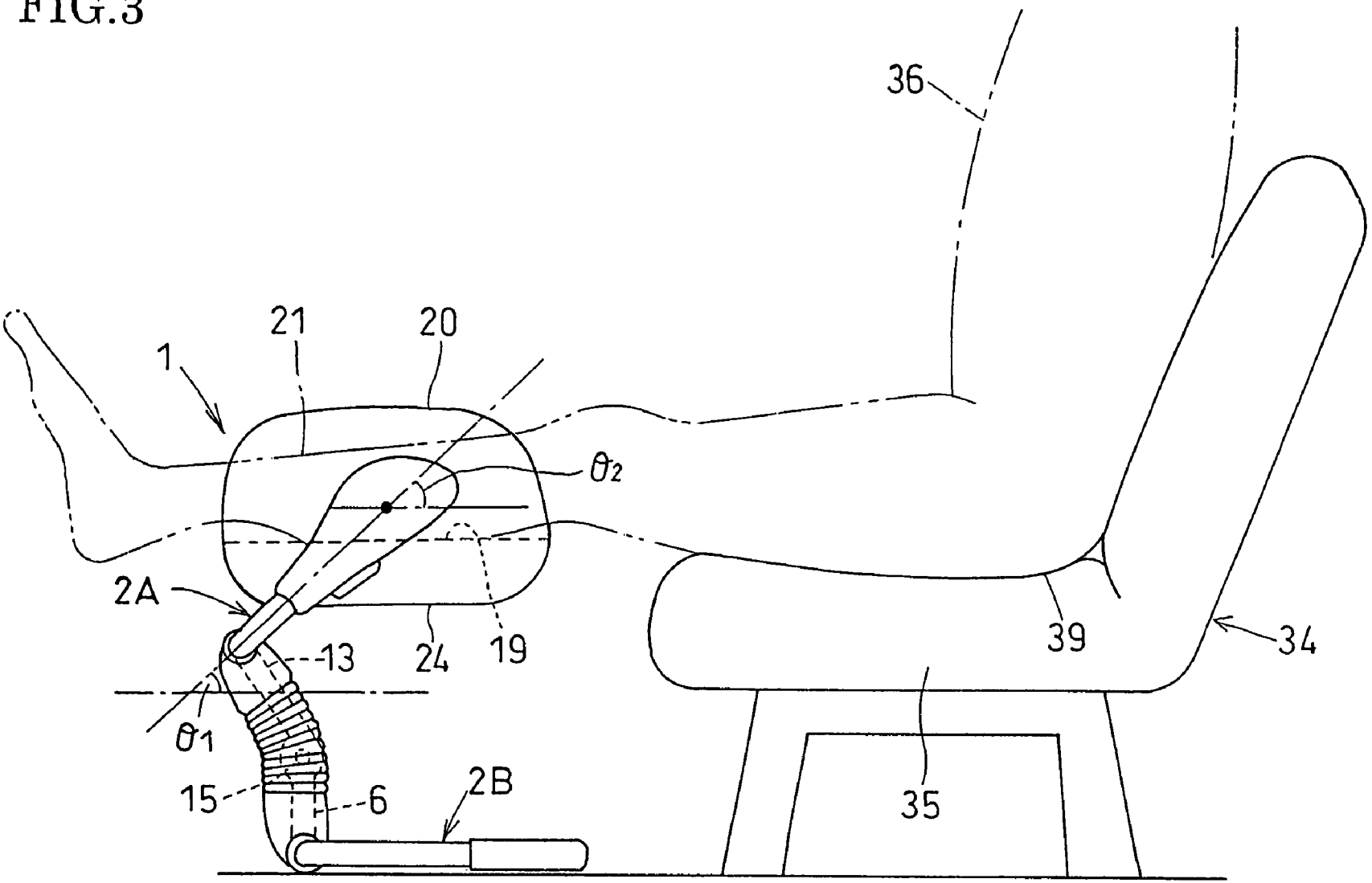
FIG. 3 is a side view showing an example of a use mode of the massage machine.

FIG. 3 shows a mode where a user uses the lower-limb massage machine 1 under the state that the user sits on a chair 34 having legs. In this case, the lower-limb massage machine 1 is disposed on a front side of the chair 34, and the height of the casing 20 is set at substantially the same height as a seat portion 35 by setting the bending angle θ1 of the upper stand member 2A with respect to the lower stand member 2B to a large value by the ratchet mechanism 15.

In this arrangement, the attitude is held so that a rotational angle θ2 of the casing 20 is substantially equal to the bending angle θ1 of the upper stand member 2A, and the recess portions 19 of the casing 20 are kept in substantially horizontal position in the front-and-rear direction. Accordingly, a user 36 can massage his/her lower limbs 21 with his/her legs stretched and his/her lower limbs 21 kept in a substantially horizontal position.

Figure 4:
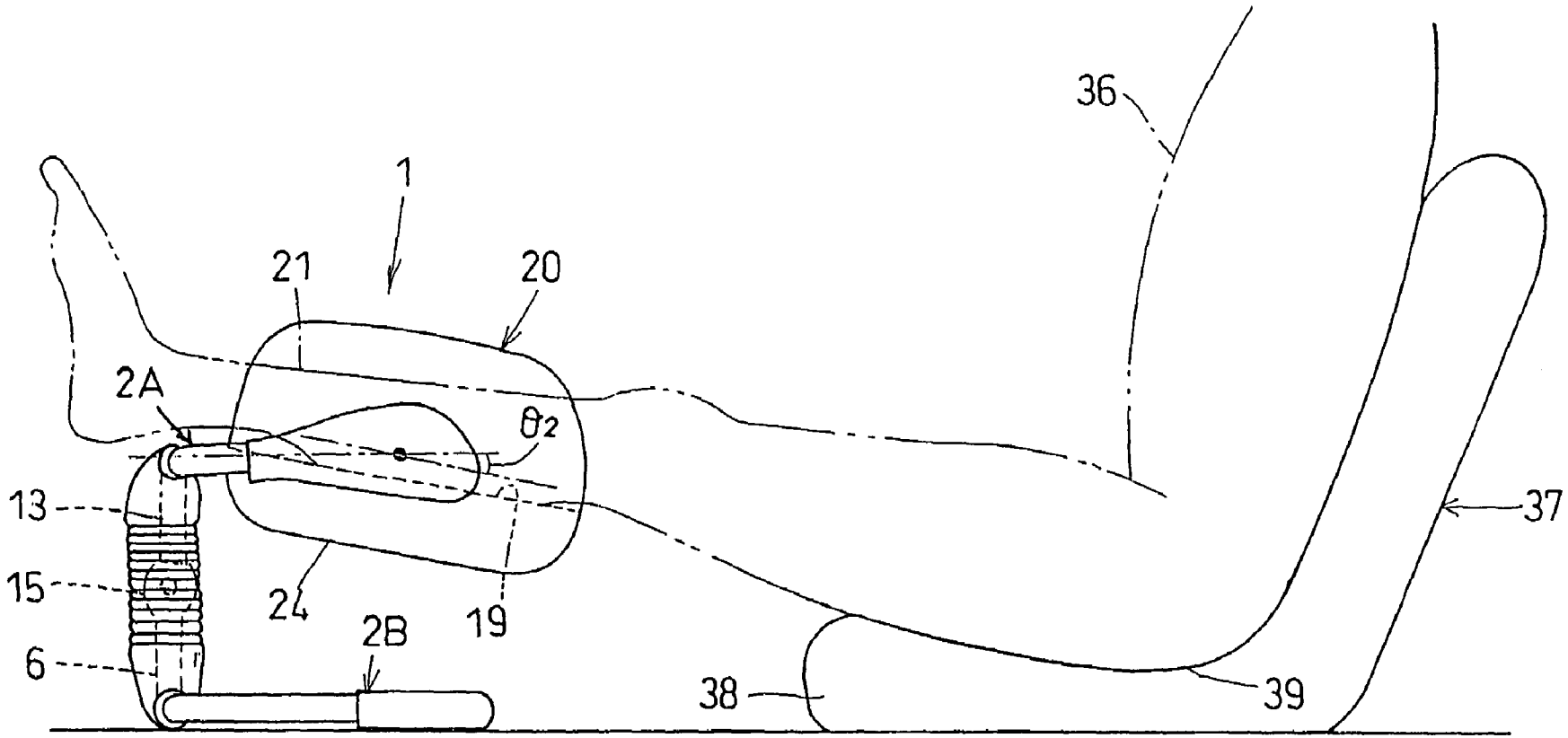
FIG. 4 is a side view showing another example of the use mode of the massage machine.

FIG. 4 shows a mode where the lower-limb massage machine 1 is used under the state that the user sits on a no-leg chair 37. In this case, the lower-limb massage machine 1 is disposed on a front side of the chair 37, and the bending angle θ1 of the upper stand member 2A is set to substantially zero by the ratchet mechanism 15, that is, it is kept in a substantially horizontal position. In this position, the height of the casing 20 is set to be slightly higher than a seat portion 35.

In this arrangement, the attitude is held so that the casing 20 is slightly downwardly inclined in the rearward direction (θ2 of FIG. 4). Accordingly, the user 36 can massage his/her lower limbs 21 while sitting on the chair 37 with his/her legs stretched and his/her lower limbs slightly upwardly inclined.

Although not shown in the drawings, when the casing 20 is reversed, the foot rest face 24 is positioned upside, and thus the massage machine 1 can be used as a foot rest.

Furthermore, when the casing 20 is positioned in proximity of the floor surface and the tip portions of the lower limbs (toes, heels or the like) are fitted in the recess portions 19 of the casing 20, the tip portions can be massaged.

Figure 5:
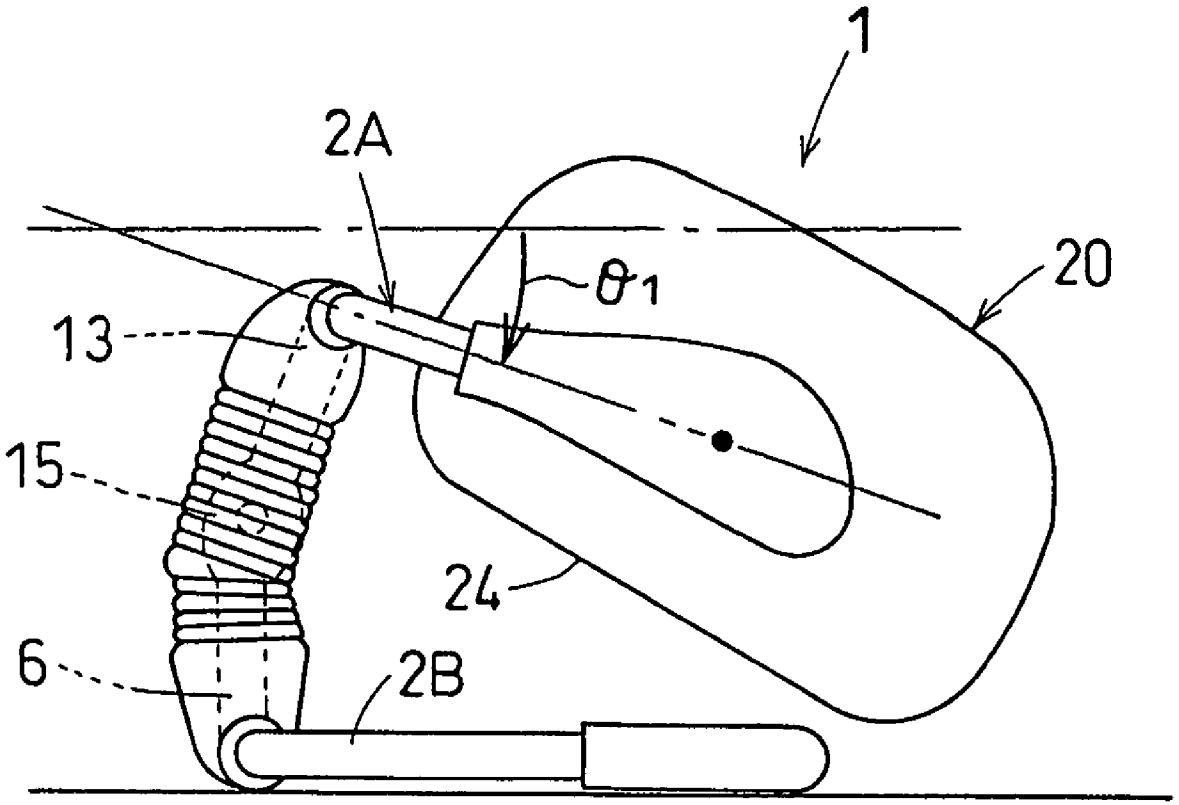
FIG. 5 is a side view showing a state where the massage machine is tucked away.

Still furthermore, by setting the ratchet mechanism 15 under a released state as shown in FIG. 5, the bending angle θ1 of the upper stand member 2A with respect to the lower stand member 2B may be set to a minus value (depression angle) to thereby set the casing 20 to the lowest position in side view. Accordingly, the dimension of the lower-limb massage machine 1 can be reduced, and it can be easily stored in a narrow space.

In the embodiments described above, for varying the attitude of the casing 20, that is, for varying the rotational angle θ2 thereof, the lock member base portion 61 is lifted upward (moved away from the support side plate 63) through the operating member 73 to release the press-fit state between the stand side set member 52A and the pivot shaft side set member 52B. This allows the casing 20 to be rotated and reversed around the pivot shaft 51.

After the casing 20 is set to a desired attitude, the lock member base portion 61 is approached to the support side plate 63 (set to the lock position), whereby the attitude of the casing 20 can be held at that position.

The present invention is not limited to the above embodiments.

The lower-limb massage machine 1 of the present invention may be provided with a fixed-height stand 2 having no angle varying mechanism 16 insofar as the attitude of the casing 20 can be freely varied. Alternatively, a stand in which the upper stand member 2A is slid in the up-and-down direction may be adopted for adjusting the height of the casing 20.

Furthermore, the angle varying mechanism 16 can vary the attitude of the casing 20 by varying the bending angle of the upper stand member 2A. Therefore, the angle varying mechanism 16 may be used also as an attitude holding mechanism 20.

INDUSTRIAL APPLICABILITY

The present invention can be used as a product for massaging lower limbs. Furthermore, the present invention can be also used as a foot rest device on which lower limbs are rested.

The invention claimed is:

1. A lower-limb massage machine, comprising:

a stand having a lower stand member to be placed on a floor surface and an upper stand member mounted on the lower stand member;

a casing having a face side formed with a pair of right and left recess portions extending in a front-and-rear direction for receiving lower limbs to be fitted in the recess portions, the casing being supported by the upper stand member through a pivot shaft so as to be rotatable around an axis extending in a right-and-left direction;

a massage mechanism incorporated in the casing for massaging the lower limbs fitted in the recess portions; and an attitude holding mechanism for holding the casing at an attitude to which the casing is rotated with respect to the upper stand member, wherein the casing has a back side formed with a foot rest face for resting lower limbs, and the casing is pivotally mounted on the upper stand member so as to be reversible, and wherein the upper stand member is mounted on the lower stand member through an angle varying mechanism for varying a bending angle of the stand in the front-and-rear direction.

2. The lower-limb massage machine according to claim 1, wherein the angle varying mechanism comprises a ratchet mechanism for stepwisely varying the bending angle.

3. The lower-limb massage machine according to claim 1, wherein the attitude holding mechanism includes a pair of set members which are secured to the upper stand member and the pivot shaft of the casing, respectively, and have confronting faces, respectively, to be brought into contact with each other; and resistance applying means for applying a rotational resistance force between the set members by pressing one of the pair of set members in a face-to-face direction against the other set member, the rotational resistance force restricting a rotation of the casing while allowing the rotation of the casing when the casing is rotated by a force larger than the rotational force.

4. The lower-limb massage machine according to claim 3, further comprising a pair of right and left side arms provided on the upper stand member for rotatably supporting the casing there between through a pivot shaft extending in the right-and-left direction, wherein the resistance applying means elastically presses one set member against the other set member by means of the right and left side arms.

5. The lower-limb massage machine according to claim 4, wherein the resistance applying means has an engagement recess and projection portion formed on each of the confronting faces of the pair of set members, the engagement recess and projection portions being engage able with each other by a pressing force and disengage able from one another by a force against the pressing force.

6. The lower-limb massage machine according to claim 3, wherein the attitude holding mechanism has lock means for preventing the rotation of the casing by increasing the pressing force of the one set member against the other set member.

7. The lower-limb massage machine according to claim 1, wherein the upper stand member is provided with rotation range restricting means for restricting the rotation of the casing around the pivot shaft to less than one turn.

8. The lower-limb massage machine according to claim 7, wherein the rotation range restricting means has a rotary disc member fixed to the pivot shaft and having a radially outwardly projecting portion, and a stopper fixed to the upper stand member for restricting the rotation of the rotary disc member through an engagement with the projecting portion.

9. A lower-limb massage machine, comprising:

a stand having a fower stand member which is to be placed on a floor surface and has a lower support pole projecting upward, and an upper stand member which has an upper support pole joined to the lower support pole of the lower stand and a pair of right and left side arms projecting from the upper support pole;

an angle varying mechanism which is disposed at a joint portion between the upper support pole and the lower support pole and can stepwisely vary a bending angle in the front-and-rear direction of the upper stand member with respect to the lower stand member;

a casing having a face side formed with a pair of right and left recess portions extending in a front-and-rear direction for receiving lower limbs fitted in the recess portions, and a back side formed with a foot rest face for resting lower limbs, the casing being rotatably supported through a pivot shaft extending in a right-and-left direction between the side arms so as to be reversible;

a massage mechanism incorporated in the casing for massaging the lower limbs fitted in the recess portions of the casing;

an attitude holding mechanism disposed between one of the side arms and the pivot shaft for allowing rotation of the casing with respect to the upper stand member while applying rotational resistance to the casing, and holding an attitude of the casing thus rotated; and rotation range restricting means disposed between the other side arm and the pivot shaft for restricting the rotation of the casing around the pivot shaft to less than one turn.

* * * * *